US010384892B2

(12) United States Patent
Harth et al.

(10) Patent No.: US 10,384,892 B2
(45) Date of Patent: Aug. 20, 2019

(54) DEVICE AND METHOD FOR RECEIVING, TRANSPORTING, AND DISPENSING FILM BAGS

(71) Applicant: Indag Gesellschaft für Industriebedarf mbH & Co. Betriebs KG, Eppelheim (DE)

(72) Inventors: Rolf Harth, Neckargemünd (DE); Frank Lechert, Weinheim (DE)

( * ) Notice: Subject to any disclaimer, the term of this patent is extended or adjusted under 35 U.S.C. 154(b) by 0 days.

(21) Appl. No.: 15/750,775

(22) PCT Filed: Aug. 5, 2016

(86) PCT No.: PCT/EP2016/068768
§ 371 (c)(1),
(2) Date: Feb. 6, 2018

(87) PCT Pub. No.: WO2017/025469
PCT Pub. Date: Feb. 16, 2017

(65) Prior Publication Data

US 2018/0229953 A1 Aug. 16, 2018

(30) Foreign Application Priority Data

Aug. 7, 2015 (EP) ..... 15180166

(51) Int. Cl.
*B65H 5/02* (2006.01)
*B65H 3/30* (2006.01)
*B65H 5/12* (2006.01)

(52) U.S. Cl.
CPC ..... *B65H 5/021* (2013.01); *B65H 3/30* (2013.01); *B65H 5/12* (2013.01); (Continued)

(58) Field of Classification Search
CPC ..... B65B 43/30; B65B 43/305; B65B 46/465; B65B 1/06; B65H 5/02; B65H 5/021
(Continued)

(56) References Cited

U.S. PATENT DOCUMENTS 3,955,334 A 5/1976 Wild et al.
7,863,536 B2 * 1/2011 Cerutti ..... B07C 3/02 198/370.03
2015/0298841 A1 * 10/2015 Ensor ..... B65B 43/465 53/475

FOREIGN PATENT DOCUMENTS

DE 10127109 A1 12/2002
EP 1035022 A1 9/2000

OTHER PUBLICATIONS

European Search Report dated Jan. 29, 2016 in European Patent Application No. 15180166.9.

* cited by examiner

*Primary Examiner* — Gene O Crawford
*Assistant Examiner* — Lester Ill Rushin

(57) ABSTRACT

The invention relates to a device for receiving, transporting, and dispensing film bags, comprising a film bag magazine with multiple parallel magazine shafts and two circulating conveyor belt devices which can be driven independently of each other and which comprise film bag receiving areas arranged thereon, said conveyor belt devices circulating about two common axes. The two axes are designed to be drivable independently of each other, and each axis drives one of the two conveyor belt devices. The invention further relates to a method for receiving, transporting, and dispensing film bags by means of the device for receiving, transporting, and dispensing film bags by means of the device for receiving, transporting, and dispensing film bags.

7 Claims, 9 Drawing Sheets

(52) U.S. Cl.
CPC .. *B65H 2404/231* (2013.01); *B65H 2404/251* (2013.01); *B65H 2404/252* (2013.01); *B65H 2404/264* (2013.01); *B65H 2701/191* (2013.01)

(58) Field of Classification Search
USPC ..... 198/617
See application file for complete search history.

DEVICE AND METHOD FOR RECEIVING, TRANSPORTING, AND DISPENSING FILM BAGS

CROSS-REFERENCE TO RELATED APPLICATIONS

This application is a U.S. national stage entry of International Application No. PCT/EP2016/068768, filed Aug. 5, 2016, which claims priority to European Application No. 15180166.9, filed Aug. 7, 2015, the contents of both of which are incorporated by reference herein in their entirety.

BACKGROUND OF THE INVENTION

1. Field of the Invention

The invention relates to a device and method for receiving, transporting and dispensing film bags.

2. Description of Related Art

It is known to transfer film bags to be supplied to further processing or to a filler from one or two magazine shafts e.g. to one or two transfer wheels and to then supply them by the latter to the further processing stations. This procedure operates continuously and is restricted as to its performance because the bags cannot be withdrawn from the stationary magazine as quickly as desired with a withdrawal device, e.g. a suction piece, rotating along with the transfer wheel while the latter passes by the magazine.

SUMMARY OF THE INVENTION

The object of the invention is to securely permit the receiving, transporting, and dispensing of film bags even at high machine speeds.

The object is achieved by the device and by the method described herein. Preferred embodiments and further developments are also disclosed.

The device for receiving, transporting and dispensing film bags comprises a film bag magazine with multiple parallel magazine shafts for providing the film bags, and two circulating conveyor belt devices which can be driven independently of each other and which comprise film bag receiving areas arranged thereon, said conveyor belt devices circulating about two common axes which are designed to be drivable independently of each other, and each axis drives one of the two conveyor belt drives.

This device according to the invention therefore permits to transfer, simultaneously in a batch operation, i.e. with the first conveyor belt device being stopped, film bags from the film bag magazine simultaneously from multiple parallel magazine shafts to multiple film bag receiving areas of the first, stopped conveyor belt device. Simultaneously, the film bags can be dispensed, with the second one of the two conveyor belt devices, in a continuous operation from their film bag receiving areas to a transfer wheel, i.e. during the dispensing of the film bags, the second conveyor belt device is driven by means of the one axis, so that the film bag receiving areas arranged thereon will move together with it. From there, the film bags may be directly transferred to a spout welding machine and/or a filling machine.

Upon the transfer of the film bags to the film bag receiving areas of the first conveyor belt device, the latter may be caused to move by driving it by means of one of the two axes, and the film bag receiving areas may be thereby moved to the transfer wheel. In the meantime, the second conveyor belt device with the emptied film bag receiving areas may be moved further, so that the film bag receiving areas arranged thereon are moved to a position underneath the magazine shafts.

Correspondingly, another transfer of film bags to the film bag receiving areas of the second conveyor belt device is then effected during the standstill of the second conveyor belt device, and simultaneously, an emptying of the film bag receiving areas of the first conveyor belt device is effected in continuous operation.

It is thus not necessary to interrupt the continuous operation during the dispensing of film bags to the transfer wheel when further film bag receiving areas are equipped with film bags. Moreover, the speed during the continuous motion for dispensing the film bags to the transfer wheel may be adapted to the circumstances of the transfer wheel and the dispensing process.

Furthermore, the device may comprise a first drive device designed to be rotatable about a first axis and to be drivable by the first axis, and a second drive device designed to be rotatable about a second axis and to be drivable by the second axis, wherein the first axis and the second axis are designed to be drivable independently of each other.

Moreover, the device may comprise a first deflection device designed to be rotatable about the second axis without being drivable by the second axis, and a second deflection device designed to be rotatable about the first axis without being drivable by the first axis.

Furthermore, a first number of film bag receiving areas may be arranged at the first conveyor belt device, wherein the first conveyor belt device extends around the first drive device and around the first deflection device and is designed to be drivable by the first drive device. The film bag receiving areas may be positioned underneath the magazine shafts for receiving the film bags in a film bag receiving position. Moreover, a second number of film bag receiving areas may be arranged at the second conveyor belt device, wherein the second conveyor belt device extends around the second drive device and around the second deflection device, and is designed to be drivable by the second drive device, wherein the film bag receiving areas may be positioned underneath the magazine shafts for receiving the film bags in the film bag receiving position.

The two drive rollers drivable independently of each other permit to move the two conveyor belt devices independently of each other. Therefore, the device according to the invention permits simultaneously to transfer film bags, in a batch operation, i.e. with the first/second circulating conveyor belt device being stopped, from the film bag magazine simultaneously from multiple parallel magazine shafts at multiple film bag receiving areas of the first/second conveyor belt device, and to simultaneously dispense the film bags, in a continuous operation, from the film bag receiving areas of the second/first conveyor belt device to a transfer wheel, and from there directly e.g. to a spout welding machine and/or a filling machine. It is thus not necessary to interrupt the dispensing operation of film bags to the transfer wheel when further film bag receiving areas are being equipped with film bags.

The first axis and the second axis may be arranged at a distance with respect to each other and oriented in parallel with respect to each other, so that the first conveyor belt device and the second conveyor belt device may circulate perpendicularly about the first and the second axes.

The first conveyor belt device and the second conveyor belt device preferably have the same lengths as both circulate about the first axis and the second axis. Moreover, the first and the second conveyor belt devices are preferably oriented at least approximately aligned with respect to each other, i.e. when the projections of the first and the second conveyor belt devices are viewed in a plane perpendicular to the first axis or the second axis, respectively, they are preferably located one upon the other. This arrangement ensures that, during the independent driving of the first and the second conveyor belt devices, the film bag receiving areas arranged at the first and second conveyor belt devices, respectively, do not come into contact with the second and the first conveyor belt devices, respectively.

To permit the film bag receiving areas of the first conveyor belt device or the second conveyor belt device, respectively, to come to lie underneath the magazine shafts of the film bag magazine such that film bags may be transferred to them, the film bag receiving areas preferably have a distance with respect to each other which corresponds to the distance of the magazine shafts.

The transfer of the film bags from the magazine shafts to the film bag receiving areas may be effected in a film bag receiving position. The film bag receiving position, for example, of the first conveyor belt device is reached when all the film bag receiving areas arranged thereon have arrived underneath the magazine shafts and are stopped there. The determination of the position may be accomplished by markers and/or by an automated visual inspection.

If the number of the multiple parallel magazine shafts is N, with N=2, 3, 4, . . . n, the first number of film bag receiving areas arranged at the first circulating conveyor belt device as well as the second number of film bag receiving areas arranged at the second circulating conveyor belt device is preferably a multiple of N, i.e. the first number and the second number are N, 2N, 3N, . . . . Here, the first number and the second number may be different.

The drive device may comprise one or multiple drive rollers, and the deflection device may also comprise one or multiple deflection rollers.

The first/second conveyor belt devices may each comprise one or more conveyor belts. The film bag receiving areas of the first/second conveyor belt devices are here arranged on the one conveyor belt or, if multiple conveyor belts are provided, the film bag receiving areas are preferably each arranged on all of the multiple conveyor belts of the respective conveyor belt device. Arranged can in this case mean a firm but releasable connection between the film bag and the conveyor belt, or a firm, non-releasable connection. If the first/second conveyor belt device only comprises one conveyor belt, the first/second drive device preferably comprises a drive roller, and the first/second deflection device preferably comprises a deflection roller. If the first/second conveyor belt device comprises more than one conveyor belt, i.e. N>1, the first/second drive device preferably comprises N drive rollers, and the first/second deflection device preferably comprises N deflection rollers.

If the device comprises two or more conveyor belts each per conveyor belt device, the individual conveyor belts of the two conveyor belt devices are preferably arranged alternately, as viewed along the first axis or the second axis, respectively. The first and second drive devices and the first and second deflection devices are arranged correspondingly.

The first/second number of the film bag receiving areas arranged on the first/second conveyor belt device may each be designed as one or multiple film bag transport modules. The number of film bag receiving areas per film bag transport module preferably corresponds to the number of the multiple parallel magazine shafts of the film bag magazine.

If a conveyor belt device comprises multiple film bag transport modules, the multiple film bag transport modules may be transferred to the film bag receiving position or the film bag dispensing position one after another.

The dispensing of the film bags from the film bag receiving areas may be done in a film bag dispensing position. In the film bag dispensing position, for example, a transfer wheel or another device may be arranged which is designed to receive the film bags from the film bag receiving areas. In the film bag dispensing position, the film bag receiving areas preferably move continuously together with the respective conveyor belt device.

The device may furthermore comprise a transfer wheel in a film bag dispensing position which is designed to receive film bags from the film bag receiving areas of the first or the second conveyor belt device, respectively. The transfer wheel may be arranged upstream of a deflection starwheel and a filling machine, so that film bags that have been received, transported and dispensed to the transfer wheel by the first or second conveyor belt device, respectively, may be filled with product in the filling machine.

In a method according to the invention for receiving, transporting, and dispensing film bags with one of the devices as described above or below, therefore film bags may be transferred simultaneously, in a batch operation, from a film bag magazine with multiple parallel magazine shafts to multiple film bag receiving areas of a first conveyor belt device, and film bags may be transferred, in a continuous operation, from film bag receiving areas of a second conveyor belt device to a transfer wheel, and from there e.g. directly to a spout welding machine and/or a filling machine.

Thus, a higher performance of the device according to the invention compared to known devices is possible by means of the method.

BRIEF DESCRIPTION OF THE DRAWINGS

The included Figures represent, by way of example, aspects of the invention for a better understanding and for illustrating the invention. In the drawings.

DETAILED DESCRIPTION OF THE INVENTION

Figure 1:
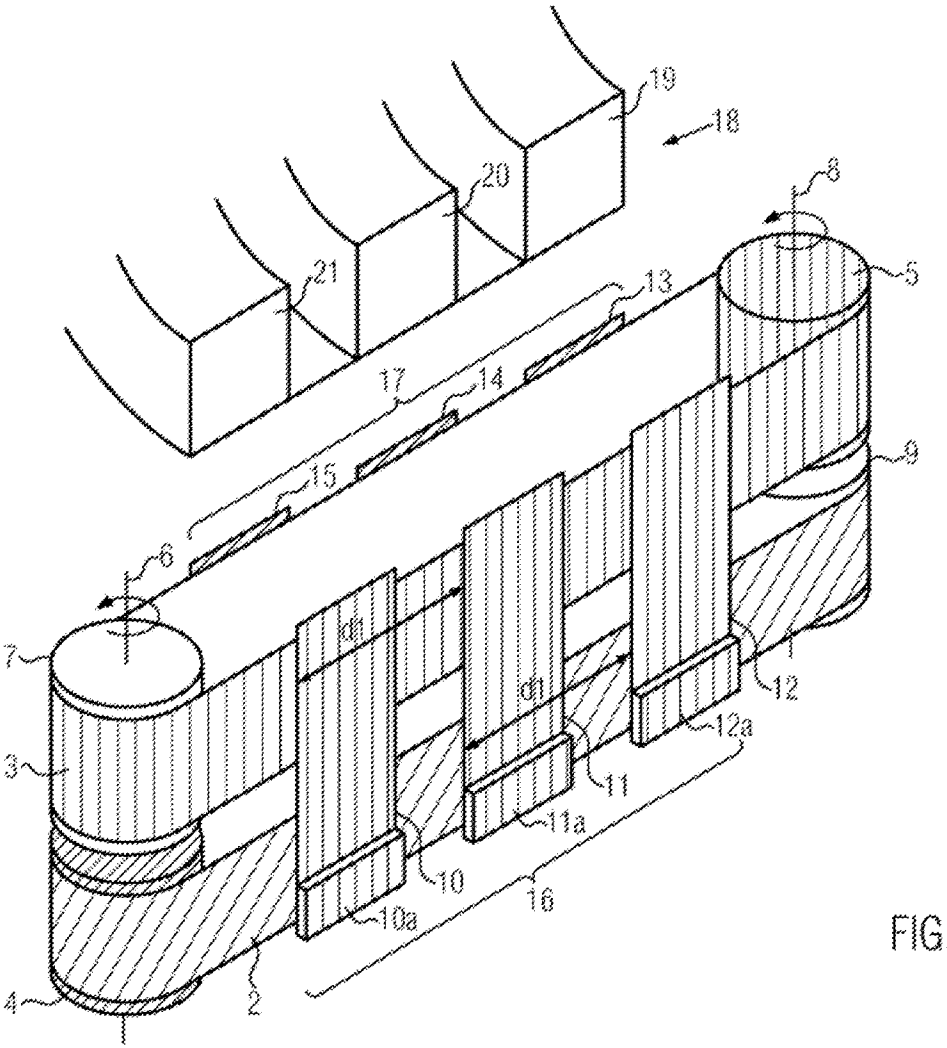
FIG. 1 shows a perspective view of a first embodiment of a device according to the invention.

FIG. 1 shows a perspective view of a first embodiment of a device 1 according to the invention. The device 1 comprises a first circulating conveyor belt device 2, and a second circulating conveyor belt device 3, wherein the first conveyor belt device 2 is designed to be drivable by a first drive device with a first drive roller 4, and the second conveyor belt device 3 is designed to be drivable by a second drive device with a second drive roller independently of each other. In the representation, the first 2 and the second conveyor belt devices 3 are each designed as circulating conveyor belts, i.e. as continuous belts.

The first drive device circulates about a first axis 6, and the first drive roller 4 is driven by the first axis 6. At the first axis 6, a second deflection device with a second deflection roller 7 for the second conveyor belt device 3 is moreover arranged, the second deflection roller 7 not being driven by the first axis 6.

Correspondingly, the second drive device circulates about a second axis 8, the second drive roller 5 being driven by the second axis 8. Moreover, a first deflection roller device with a first deflection roller 9 for the first conveyor belt device 2 is arranged at the second axis 8, the first deflection roller 9 not being driven by the second axis 8.

Thus, the first and the second drive devices are drivable independently of each other, so that the first 2 and the second conveyor belt devices 3 may accordingly move independently of each other, in other words, they can have the same speed or different speeds. Moreover, the respective speeds may be varied in response to time.

By way of example, the first 2 and the second conveyor belt devices 3 each comprise three film bag receiving areas 13, 14, 15; 10, 11, 12 forming a first film bag transport module 17 and a second film bag transport module 16. Adjacent film bag receiving areas 10-12; 13-15 of each film bag transport module 17; 16 each have the same distance d1 and are arranged on the respective conveyor belt device 2; 3 such that the distance d1 does not change during the movement of the respective conveyor belt devices 2; 3. The distance d1 is configured such that film bags may be transferred from a film bag magazine 18 to the film bag receiving areas.

The device 1 moreover comprises the film bag magazine 18 with three magazine shafts 19, 20, 21 arranged in parallel in which (non-depicted) film bags are provided which are then transferred to film bag receiving areas 10-12; 13-15 arranged under the magazine shafts and may be finally dispensed to a transfer wheel.

By the acting gravity, a film bag may fall from a magazine shaft 19-21 into a film bag receiving area 10-12; 13-15 arranged underneath, or the film bags may be transferred in a defined movement from the magazine shafts 19-21 to the film bag receiving areas 10-12; 13-15 arranged below them with a transfer device provided to this purpose.

In FIG. 1, the film bag receiving areas 10-12 have one mounting 10*a*, 11*a*, 12*a* each at their lower ends which ensure a safe receipt of the film bags. The film bag receiving areas 13-15 of the first film bag transport module 17 also include such mountings (not visible).

Figure 2:
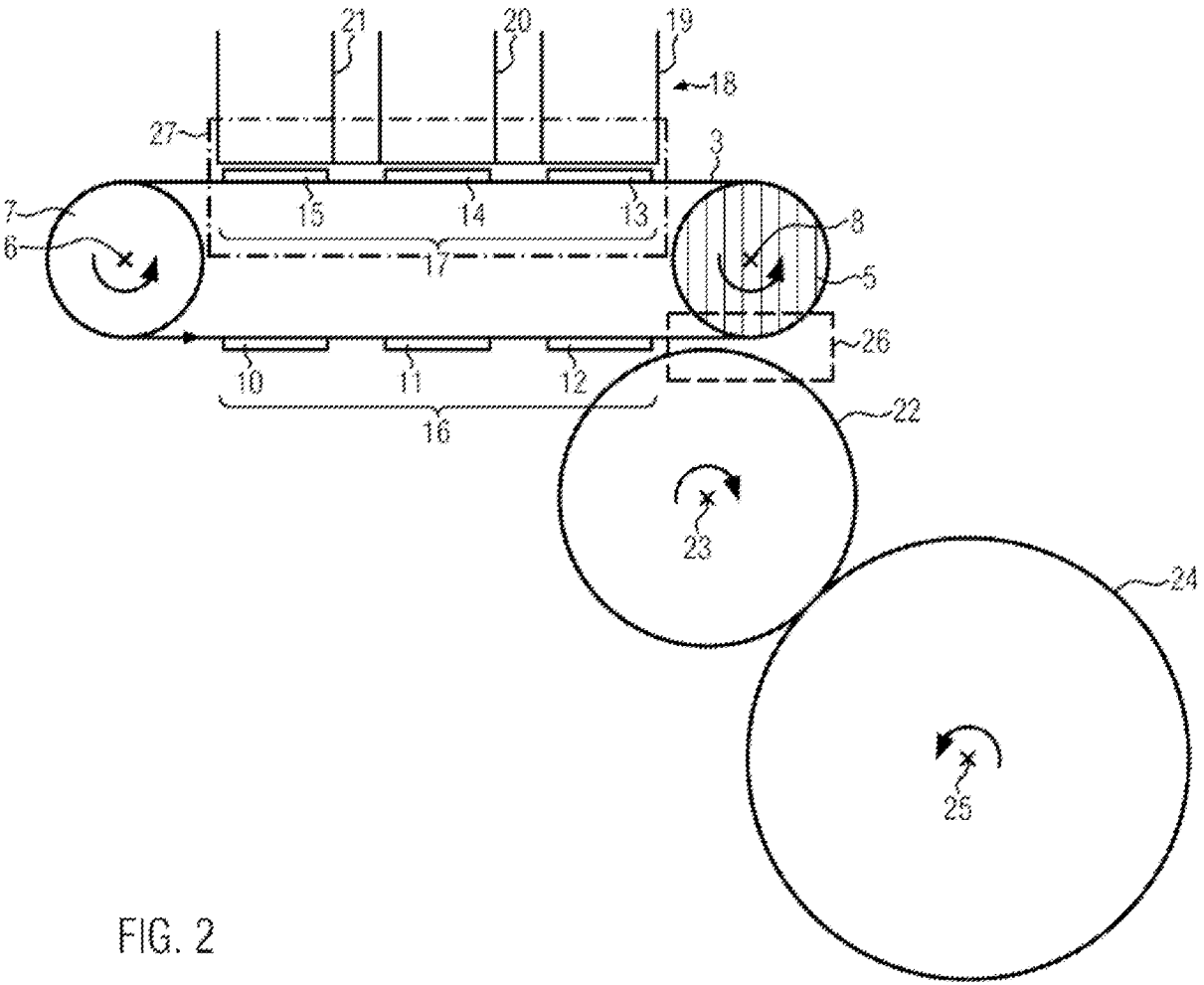
FIG. 2 shows a plan view onto the first embodiment.

FIG. 2 shows a plan view onto the device 1 represented in FIG. 1. The first film bag transport module 17 arranged on the first conveyor belt device 2, and the second film bag transport module 16 arranged on the second conveyor belt device 3 are visible. Of the two conveyor belt devices that are superimposed (as viewed in the direction of the two axes 6, 8), only the upper, second conveyor belt device 3 is seen in the plan view.

The film bags, that have been received from the film bag receiving areas in a film bag receiving position 27 in a batch operation while the conveyor belt device was standing still, are continuously dispensed in a film bag dispensing position 26, i.e. while the conveyor belt device is moving, to a transfer wheel 22 rotatable about the axis 23. From there, the film bags may be directly transferred to a spout welding machine and/or to a filling machine 24 that is rotatable about the axis 25.

The method according to the invention that can be carried out with this device will be described with reference to FIGS. 5 and 6A-6D.

Figure 3:
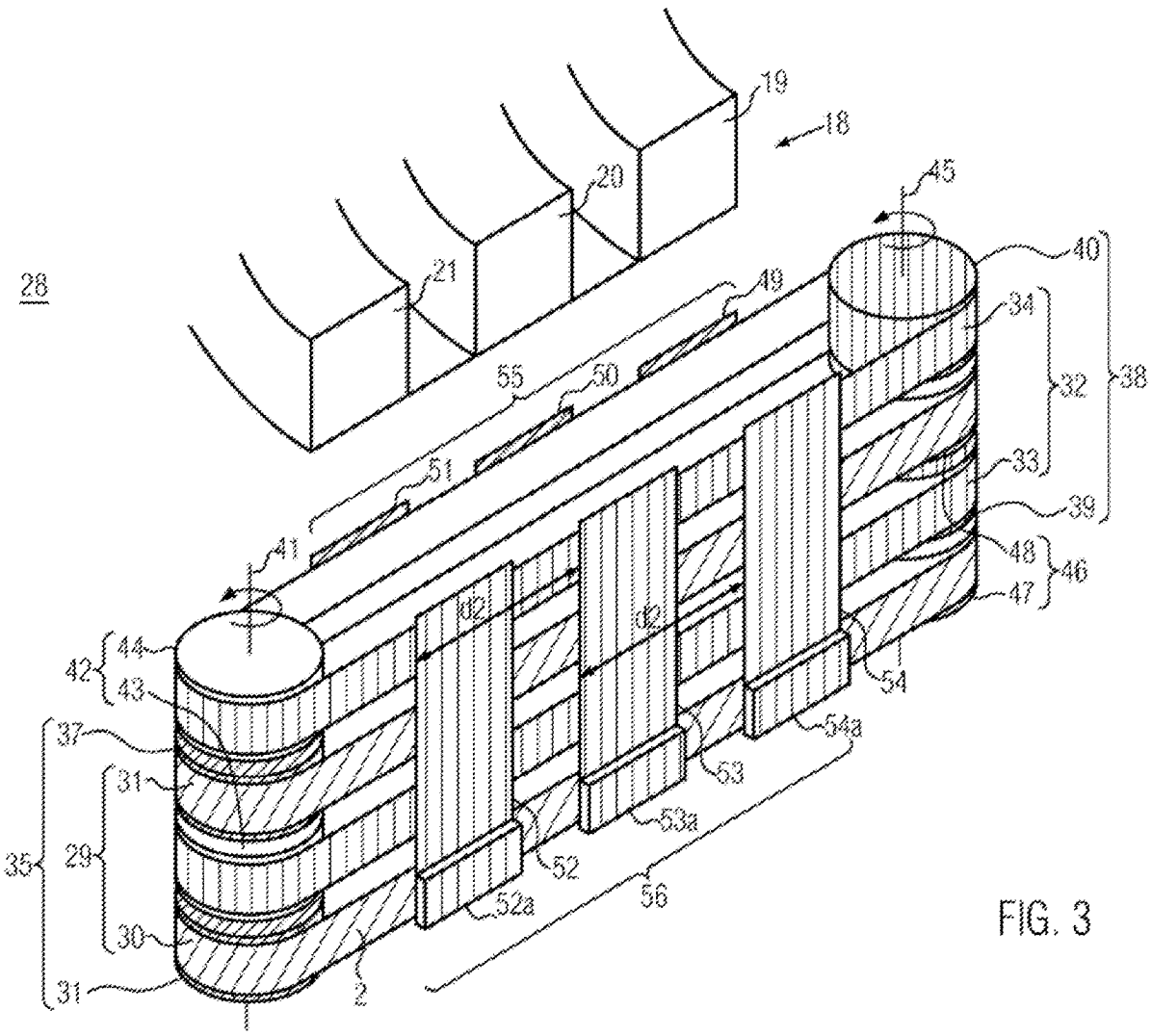
FIG. 3 shows a perspective view of a second embodiment of a device according to the invention.

FIG. 3 shows a perspective view of a second embodiment of a device 28 according to the invention which, in contrast to the first embodiment of FIG. 1, has two circulating conveyor belts 30, 31; 33, 34 per conveyor belt device 29, 32.

The first conveyor belt device 29 is driven by a first drive device 35 with two first drive rollers 36, 37, and correspondingly, the second conveyor belt device 32 is driven by a second drive device 38 with two second drive rollers 39, 40.

The first drive device 35 circulates about a first axis 41, and the two first drive rollers 36, 37 are driven by the first axis 41. At the first axis 41, a second deflection device 42 with two second deflection rollers 43, 44 for the second conveyor belt device 32 is moreover arranged, the two second deflection rollers 43, 44 not being driven by the first axis 41.

Correspondingly, the second drive device 38 circulates about a second axis 45, the two second drive rollers 39, 40 being driven by the second axis 45. Moreover, a first deflection roller device 46 with two first deflection rollers 47, 48 for the first conveyor belt device 29 is arranged at the second axis 45, the two first deflection rollers 47, 48 not being driven by the second axis 45.

The first 35 and the second drive devices 38 are therefore drivable independently of each other, so that the first 29 and the second conveyor belt devices 32 correspondingly move independently of each other.

By way of example, the first 29 and the second conveyor belt devices 32 each comprise three film bag receiving areas 49, 50, 51; 52, 53, 54 forming a first film bag transport module 55 and a second film bag transport module 56, respectively. Adjacent film bags 49-51; 52-54 of a film bag transport module 55; 56 each have the same distance d2, and the film bag transport modules are arranged on the respective conveyor belt device 29; 32 such that the distance d2 does not change during the movement of the respective conveyor belt devices 29, 32. The distance d2 is designed such that film bags from a film bag magazine 18 may be transferred to film bag receiving areas located in the film bag receiving position.

The device 28 according to the invention furthermore comprises, just as the first embodiment of the device 1, a film bag magazine 18 with three magazine shafts 19, 20, 21 arranged in parallel which was already described in FIG. 1. The film bags may be caused to fall from a magazine shaft 19-21 into a film bag receiving area 49-51; 52-54 arranged underneath, or they may be transferred with a transfer device provided to this purpose in a defined movement from the magazine shafts 19-21 to the film bag receiving areas 49-51; 52-54 arranged below.

In FIG. 3, the film bag receiving areas 52-54 have one mounting 52*a*, 53*a*, 54*a* each at their lower ends which ensure a safe receipt of the film bags. The film bag receiving areas 49-51 of the first film bag transport module 55 also include such mountings (not visible).

In FIGS. 4A-4D, the film bag magazine is omitted for clarity reasons.

Figure 4A:
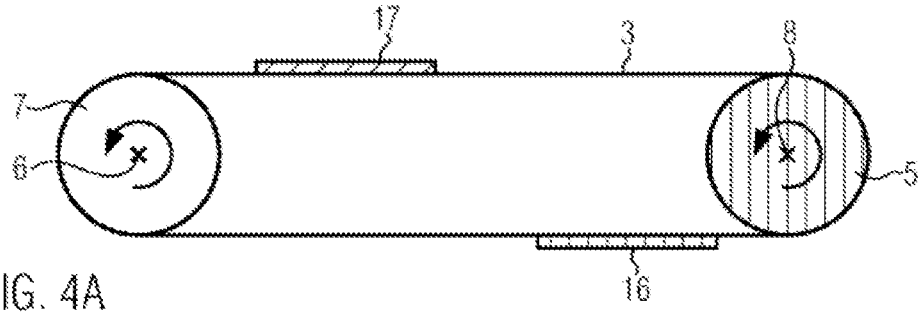
FIG. 4A shows a plan view onto the first embodiment with two film bag transport modules.

FIG. 4A shows a plan view onto the first embodiment of the device 1 according to the invention. The second conveyor belt device 3 is driven by means of the axis 8 and the second drive roller 5, the second film bag transport module 16 being arranged at the second conveyor belt device 3. The second conveyor belt device 3 circulates around the second deflection roller 7 arranged on the first axis 6.

The first conveyor belt device 2, which is driven by means of the first axis 6 and on which the first film bag transport module 17 is arranged, cannot be seen in the plan view as it is located underneath the second conveyor belt device 3 as viewed in the direction of the axes 6, 8. The first film bag transport module 17 is positioned, with respect to the second conveyor belt device 3, such that it is not influenced by a movement of the second conveyor belt device 3. The same applies to the second film bag transport module 16 with respect to the first conveyor belt device 2.

Figure 4B:
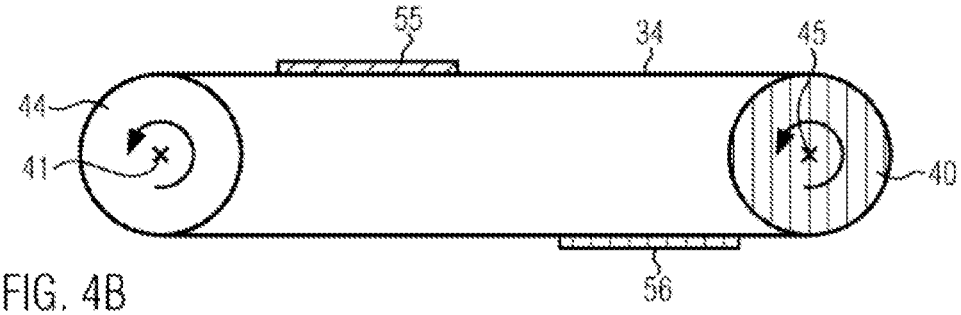
FIG. 4B shows a plan view onto the second embodiment with two film bag transport modules.

FIG. 4B shows a plan view onto the second embodiment of the device 28 according to the invention. The second conveyor belt device 32 is driven by means of the axis 45 and the two second drive rollers 39, 40 of which the upper drive roller 40 is seen in the plan view. At the second conveyor belt device 32, the second film bag transport module 56 is arranged. In the plan view, the upper conveyor belt 34 of the second conveyor belt device 32 can be seen. The second conveyor belt device 32 circulates around the two second deflection rollers 43, 44 arranged on the first axis 41; in the plan view, the upper deflection roller 44 can be seen.

The first conveyor belt device 29, which is driven by means of the first axis 41, cannot be seen in the plan view as it is located underneath the second conveyor belt device 32 as viewed in the direction of the axes 40, 41. The first film bag transport module 55 is arranged on the second conveyor belt device 29. The first film bag transport module 55 is positioned, with respect to the second conveyor belt device 32, such that it is not influenced by a movement of the second conveyor belt device 32. The same applies to the second film bag transport module 56 with respect to the first conveyor belt device 29.

Figure 4C:
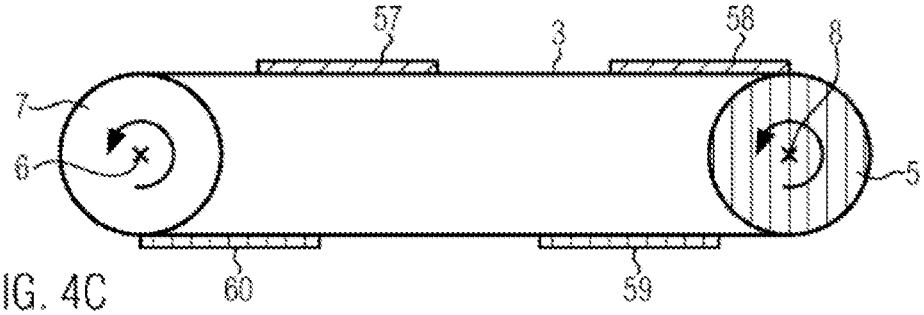
FIG. 4C shows a plan view onto a device corresponding to the first embodiment with four film bag transport modules.

FIG. 4C shows a plan view onto a device corresponding to the first embodiment. At the first conveyor belt device 2 (which is not visible), two first film bag transport modules 57, 58 are arranged. The term "first" film bag transport modules 57, 58 is to clarify here that these two film bag transport modules 57, 58 are part of the first conveyor belt device 2; thus, there is a first first transport module 57 and a second first transport module 58.

At the second conveyor belt device 3, two second film bag transport modules 59, 60 are arranged. The term "second" film bag transport modules 59, 60 is to clarify here that these two film bag transport modules 59, 60 are part of the second conveyor belt device 3; thus, there is a first second transport module 59 and a second second transport module 60. The two first film bag transport modules 57, 58 are positioned with respect to the second conveyor belt device 3 such that they are not influenced by a movement of the second conveyor belt device 3. The same applies to the two second film bag transport modules 59, 60 with respect to the first conveyor belt device 2.

Figure 4D:
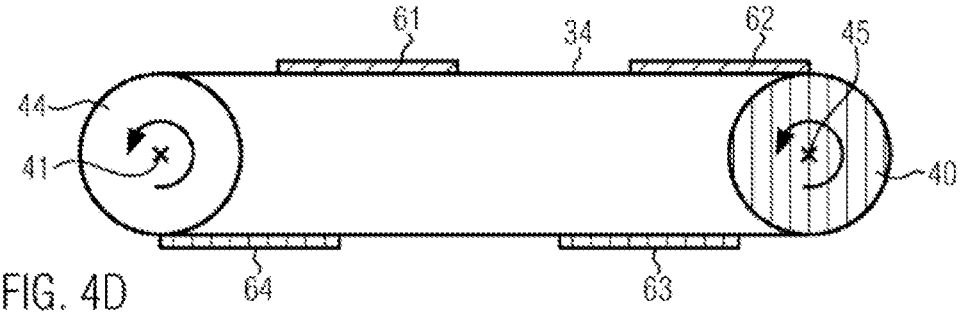
FIG. 4D shows a plan view onto a device corresponding to the second embodiment with four film bag transport modules.

FIG. 4D shows a plan view onto a device corresponding to the second embodiment. At the first conveyor belt device 29, two first film bag transport modules 61, 62 are arranged, and at the second conveyor belt device 32, two second film bag transport modules 63, 64 are arranged. The two first film bag transport modules 61, 62 are positioned with respect to the second conveyor belt device 32 such that they are not influenced by a movement of the second conveyor belt device 32. The same applies to the two second film bag transport modules 63, 64 with respect to the first conveyor belt device 29.

Figure 5:
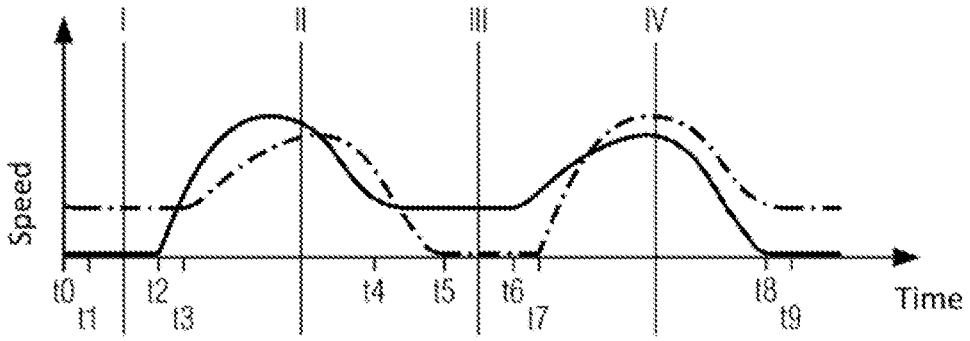
FIG. 5 shows a time history of the speeds of the two conveyor belt devices each with one film bag transport module, FIGS. 6A-6D each show a plan view onto the device at different points in time.

FIG. 5 shows a time history of the speeds of the two conveyor belt devices of a device according to the invention, wherein the first and the second conveyor belt devices each comprise one film bag transport module. The speed may be represented in the unit meter per second, and the time in the unit seconds. In the representation, the solid line is assigned to the first conveyor belt device, and the dot-dash line is assigned to the second conveyor belt device.

The points in time explicitly represented by the four lines I, II, III, IV are represented in FIGS. 6A-6D each by one plan view onto the device.

Corresponding to the shown speed characteristic over time, the first film bag transport module of the first conveyor belt device reaches the film bag receiving position at the point in time t0 and remains in this position until the point in time t2. The speed of the first conveyor belt device is zero in the period t0 to t2. In the film bag receiving position, film bags which are provided by the magazine are transferred to the film bag receiving areas arranged underneath.

After the film bags have been transferred to the film bag receiving areas, the first conveyor belt device is initially accelerated, and then slowed down again before the first film bag transport module reaches the film bag dispensing position. The film bag dispensing position is reached by the first film bag transport module at the point in time t4 and left at the point in time t6. In the region of the film bag dispensing position, the first conveyor belt device and thus the first film bag transport module move at a constant speed. It is thus possible to dispense the film bags from the film bag receiving areas of the first film bag transport module to a transfer wheel.

After the first film bag transport module has left the film bag dispensing position, the first conveyor belt device is accelerated at the point in time t6 and then slowed down again before the first film bag transport module has reached the film bag receiving position. The first film bag transport module is in the film bag receiving position at the point in time t8; the speed of the first conveyor belt device is zero. The empty film bag receiving areas of the first film bag transport module are again filled with film bags. The described steps can then be carried out again correspondingly.

The second conveyor belt device is slowed down before the second film bag transport module reaches the film bag dispensing position. The film bag dispensing position is reached by the second film bag transport module at the point in time t1 and left at the point in time t3. In the region of the film bag dispensing position, the second conveyor belt device and thus the second film bag transport module move at a constant speed. The film bags of the film bag receiving areas may be transferred to the transfer wheel.

After the second film bag transport module has left the film bag dispensing position, the second conveyor belt device is accelerated and slowed down again before the second film bag transport module reaches the film bag transfer position. The second film bag transport module is located in the film bag receiving position from the point in time t5 to the point in time t7. The speed of the second conveyor belt device is zero in the period t5 to t7. In the film bag receiving position, film bags which are provided by the magazine are transferred to the film bag receiving areas of the second film bag transport module arranged underneath.

After the end of the transfer, the second conveyor belt device is first accelerated and then, before the second film bag transport module reaches the film bag dispensing position, slowed down again. The film bag dispensing position is reached by the second film bag transport module at the point in time t9, and the second conveyor belt device is moving at a constant speed. The described steps can then be carried out again correspondingly.

For the use of a device according to the invention with two conveyor belt devices each including one film bag transport module, all magazine shafts 19-21 of the film bag magazine 18 are first equipped with film bags. The first film bag transport module 17 is moved, by means of the first conveyor belt device 2, to a region underneath the film bag magazine 18 and thereby under its magazine shafts, and then stopped when the film bag receiving areas 13-15 are positioned under the magazine shafts 19-21 such that one film bag each can be caused to fall out of a magazine shaft 19-21 into a film bag receiving area 13-15 arranged thereunder, or can be transferred to it.

Since the first 17 and the second film bag transport modules 16 are drivable independently of each other, during the stopped movement of the first conveyor belt device 2, the second film bag transport module 16 may be moved to the film bag dispensing position by means of the second conveyor belt device 3, so that film bags of the second film bag transport module 16 may be dispensed to a transfer wheel 22 in the film bag dispensing position.

Figure 6A:
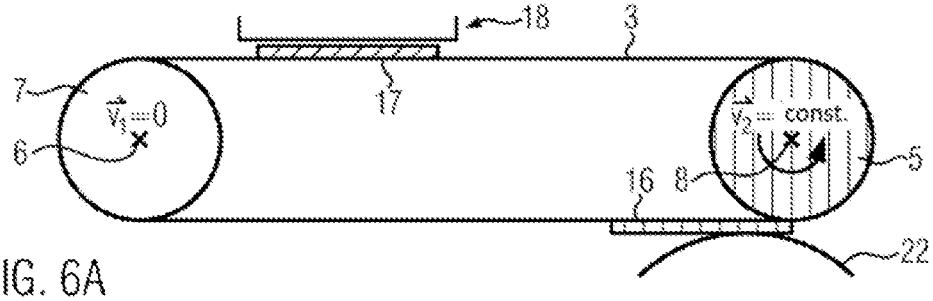

FIG. 6A now shows a plan view onto the first embodiment of the device 1 according to the invention at the point in time 1 where the movement of the first conveyor belt device 2 has stopped. Instead of the first embodiment, the second one may be used. The first film bag transport module 17 is located in the film bag receiving position underneath the film bag magazine 18, so that film bags may be caused to fall from the film bag magazine 18 into the film bag receiving areas or be transferred to them. The first film bag conveyor device 2 is at rest to this end, i.e. $\overline{v1}=0$. The second film bag transport module 16 is located in the film bag dispensing position, so that film bags may be dispensed to the transfer wheel 22. The second film bag conveyor device 3 is moving at a constant speed, i.e. $\overline{v2}=\text{const}$.

When the first film bag transport module 17 is filled with film bags, it is moved towards the film dispensing position and gradually dispenses the individual film bags to the transfer wheel 22 in a continuous operation. Already when the first film bag transport module 17 is leaving the film bag receiving position under the film bag magazine 18, the second film bag transport module 16 is moved from the film bag dispensing position to the film bag receiving position.

Figure 6B:
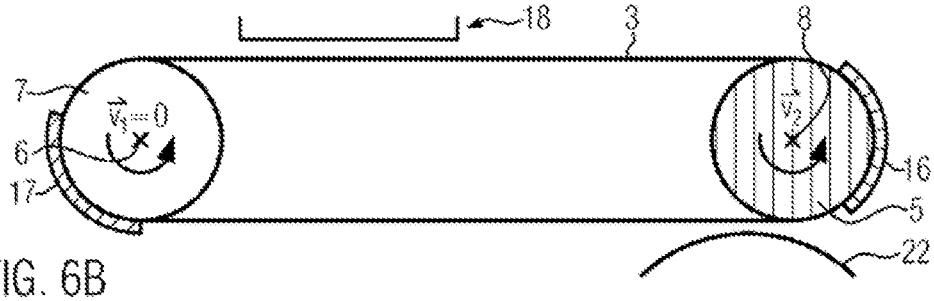

FIG. 6B shows a plan view at the point in time II where both the first 2 and the second conveyor belt devices 3, and thus the first 17 and the second film bag transport modules 16, are moving at the speed $\overline{v1}$ or $\overline{v2}$, respectively. The first film bag transport module 17 has left the film bag receiving position, and the second film bag transport module 16 has left the film bag dispensing position.

Figure 6C:
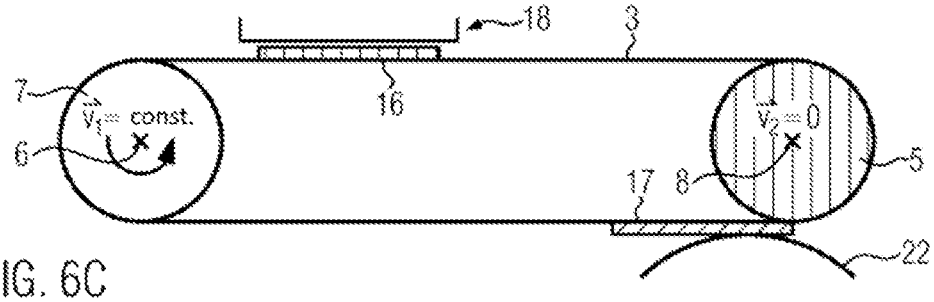

FIG. 6C shows a plan view at the point in time III. Now, the second film bag transport module 16 is located in the film bag receiving position underneath the film bag magazine 18, so that film bags may be transferred from the film bag magazine 18 to the emptied film bag receiving areas. The second film bag transport device 3 is at rest for receiving the film bags from the film bag magazine 18, i.e. $\overline{v2}=0$. The first film bag transport module 17 is located in the film bag dispensing position, so that film bags may be dispensed to the transfer wheel 22. The first film bag conveyor device 2 is moving at a constant speed, i.e. $\overline{v1}=\text{const}$.

Figure 6D:
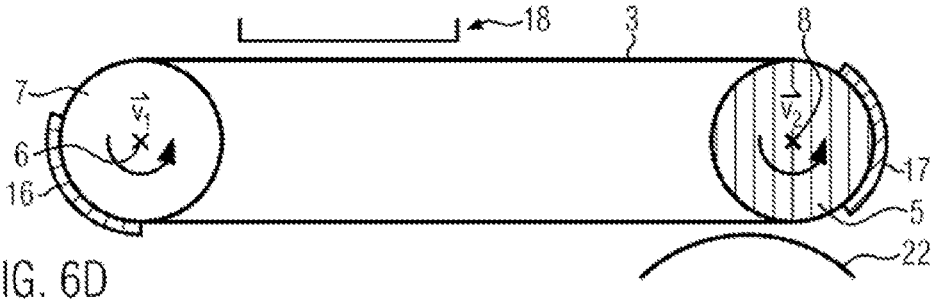

FIG. 6D shows a plan view at the point in time IV where both the first 2 and the second conveyor belt devices 3, and thus the first film bag transport module 17 and the second film bag transport module 16, are moving at the speed $\overline{v1}$ or $\overline{v2}$, respectively. The first film bag transport module 17 has left the film bag dispensing position, and the second film bag transport module 16 has left the film bag receiving position.

Figure 7:
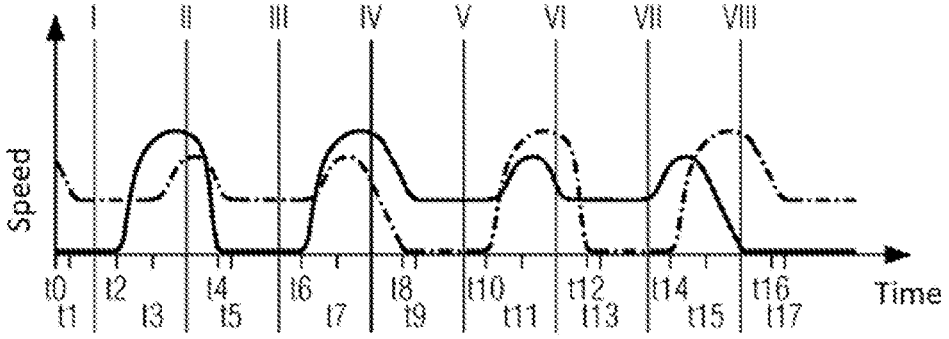
FIG. 7 shows a time history of the speeds of the two conveyor belt devices each with two film bag transport modules, and FIGS. 8A-8H each show a plan view onto the device at different points in time.

FIG. 7 shows a time history of the speeds of the two conveyor belt devices of a device according to the invention with two film bag transport modules each. The speed may be represented in the unit meter per second, and the time in the unit seconds. In the representation, the solid line is assigned to the first conveyor belt device, and the dot-dash line is assigned to the second conveyor belt device.

The points in time explicitly represented by the eight lines I, II, III, IV, V, VI, VII, VIII are represented in FIGS. 8A-8H each by a plan view onto the device each.

Corresponding to the shown speed characteristic over time, the first first film bag transport module of the first conveyor belt device reaches the film bag receiving position at the point in time t0 and remains in this position until the point in time t2. The speed of the first conveyor belt device is zero in the period t0 to t2. In the film bag receiving position, film bags which are provided by the film bag magazine are transferred to the film bag receiving areas of the first first film bag transport module arranged underneath. The second first film bag transport module is neither moving in the period t0 to t2; however, it is not located in the film bag receiving position.

After the film bags have been transferred to the film bag receiving areas of the first first film bag transport module, the first conveyor belt device is accelerated at the point in time t2 and then slowed down again before the second first film bag transport module reaches the film bag receiving position at the point in time t4. The second first film bag transport module reaches the film bag receiving position at the point in time t4 and remains there until the point in time t6. The speed of the first conveyor belt device is zero in the period t4 to t6. In the film bag receiving position, film bags which are provided by the film bag magazine are transferred to the film bag receiving areas of the second first film bag transport module arranged underneath. The first first film bag transport module of the first conveyor belt device is neither moving in the period t4 to t6; it is not in the film bag receiving position during this time.

After the film bags have been transferred to the film bag receiving areas of the second first film bag transport module, the first conveyor belt device is accelerated at the point in time t6 and then slowed down again before the first first film bag transport module reaches the film bag dispensing position at the point in time t9. While the first first film bag transport module is in the region of the film bag dispensing position in the period t9 to t11, the first conveyor belt device is moving at a constant speed. Thus, the film bags may be transferred from the film bag receiving areas of the first first film bag transport module to the transfer wheel.

After the first first film bag transport module has left the film bag dispensing position, the first conveyor belt device is accelerated at the point in time t11 and then slowed down again before the second first film bag transport module reaches the film bag dispensing position at the point in time t12. While the second first film bag transport module is in the region of the film bag dispensing position in the period t12 to t14, the first conveyor belt device is moving at a constant speed to dispense the film bags from the film bag receiving areas of the second first film bag transport module to the transfer wheel.

After the second first film bag transport module has left the film bag dispensing position at the point in time t14, the first conveyor belt device is accelerated at the point in time t14. When the first first film bag transport module reaches the film bag receiving position again at the point in time t16, the first conveyor belt device is slowed down. When the first first film bag transport module is in the film bag receiving position, the movement of the first conveyor belt device stops. The empty film bag receiving areas may then be filled again with film bags.

Corresponding to the represented speed characteristic over time, the following characteristic results for the second conveyor belt device. Before the first second film bag transport module of the second conveyor belt device reaches the film bag dispensing position at the point in time t1, the second conveyor belt device is slowed down. While the first second film bag transport module is located in the region of the film bag dispensing position in the period t1 to t3, the second conveyor belt device is moving at a constant speed, so that the film bags may be transferred from the film bag receiving areas of the first second film bag transport module to the transfer wheel.

After the first second film bag transport module has left the film bag dispensing position, the first conveyor belt device is accelerated at the point in time t3 and then slowed down again before the second second film bag transport module reaches the film bag dispensing position at the point in time t5. While the second second film bag transport module is in the region of the film bag dispensing position in the period t5 to t7, the second conveyor belt device is moving at a constant speed to transfer the film bags from the film bag receiving areas of the second second film bag transport module to the transfer wheel.

After the second second film bag transport module has left the film bag dispensing position at the point in time t7, the second conveyor belt device is accelerated at the point in time t7. When the first second film bag transport module reaches the film bag receiving position again at the point in time t8, the second conveyor belt device is slowed down. If the first second film bag transport module is in the film bag receiving position, the movement of the second conveyor belt device stops. While the first second film bag transport module is located in the film bag receiving position in the period t8 to t10, the empty film bag receiving areas may be equipped again with film bags. The speed of the second conveyor belt device is zero in the period t8 to t10. The second second film bag transport module of the second conveyor belt device is neither moving in the period t8 to t10; however, it is not in the film bag receiving position.

After the film bags have been transferred to the film bag receiving areas of the first second film bag transport module, the second conveyor belt device is accelerated at the point in time t10 and then slowed down again before the second second film bag transport module reaches the film bag receiving position at the point in time t13. The second second film bag transport module reaches the film bag receiving position at the point in time t13 and remains in it until the point in time t15. The speed of the second conveyor belt device is zero in the period t13 to t15. Film bags that are provided by the film bag magazine are transferred to the film bag receiving areas of the second second film bag transport module arranged thereunder. The first second film bag transport module is neither moving in the period t13 to t15; however, it is not in the film bag receiving position.

After the film bags have been transferred to the film bag receiving areas of the second second film bag transport module, the second conveyor belt device is accelerated at the point in time t15 and then slowed down again before the first second film bag transport module reaches the film bag dispensing position again at the point in time t17.

FIGS. 8A-8H each show a plan view onto the device at different times I to VIII as stated in FIG. 7.

Figure 8A:
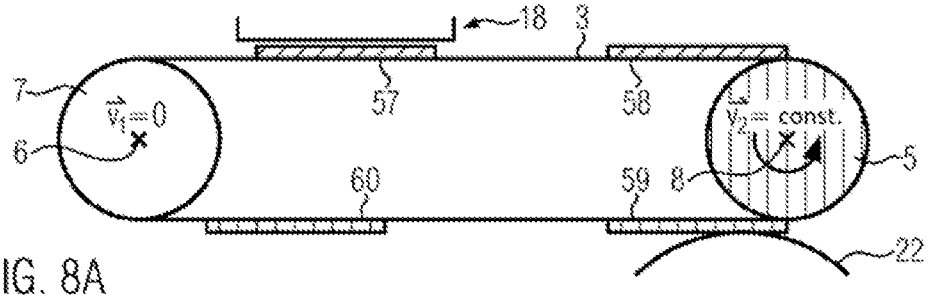

FIG. 8A shows a plan view onto an embodiment of the device according to the invention with two conveyor belt devices with two film bag transport modules each at the point in time I where the movement of the first conveyor belt device 2 has stopped. The first first film bag transport module 57 is located in the film bag receiving position underneath the film bag magazine 18, so that film bags from the film bag magazine 18 may be caused to fall into the film bag receiving areas or transferred to them. The first film bag conveyor device 2 is at rest to this end, i.e. $\overline{v1}=0$. The second first film bag transport module 58 is correspondingly also at rest.

The first second film bag transport module 59 is located in the film bag dispensing position, so that film bags may be dispensed to the transfer wheel 22. The second film bag conveyor device 3 is moving at a constant speed, i.e. $\overline{v2}$=const. The second second film bag transport module 60 is on its way to the film bag dispensing position.

Figure 8B:
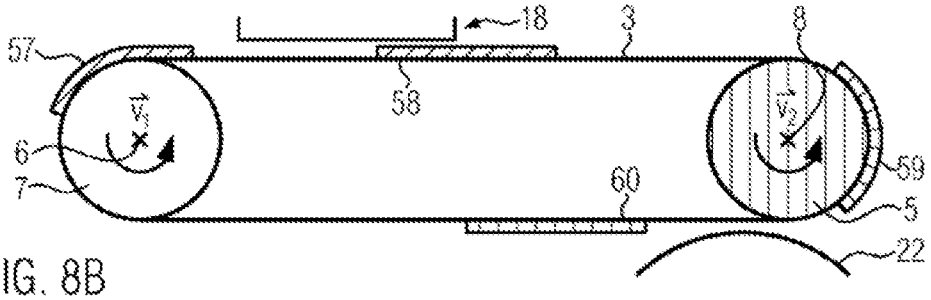

FIG. 8B shows a plan view at the point in time II where both the first 2 and the second conveyor belt devices 3 and thus the respective film bag transport modules 57, 58; 59, 60 move at the speed $\overline{v1}$ or $\overline{v2}$, respectively. The first first film bag transport module 57 has left the film bag receiving position, the second first film bag transport module 58 is on its way to the film bag receiving position, the first second film bag transport module 59 has left the film bag dispensing position, and the second second film bag transport module 60 is on its way thereto.

Figure 8C:
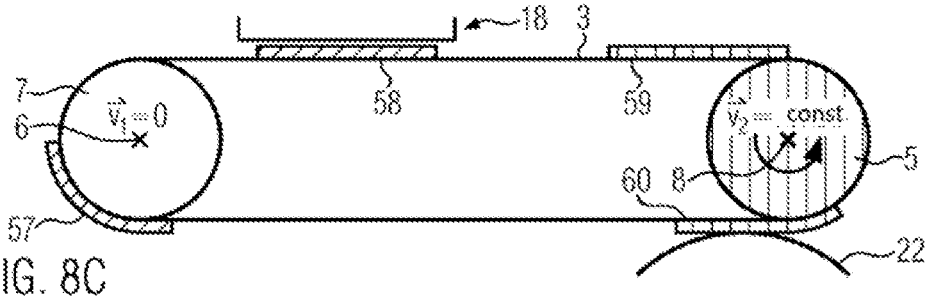

FIG. 8C shows a plan view at the point in time III. The second first film bag transport module 58 is located in the film bag receiving position underneath the film bag magazine 18 for receiving film bags from the film bag magazine. The first film bag conveyor device 2 is at rest to this end, i.e. $\overline{v1}=0$. The first first film bag transport module 57 is correspondingly also at rest.

The first second film bag transport module 59 is on its way to the film bag receiving position, and the second second film bag transport module 60 is located in the film bag dispensing position, so that film bags may be transferred to the transfer wheel 22. The second film bag conveyor device 3 is moving at a constant speed, i.e. $\overline{v2}$=const.

Figure 8D:
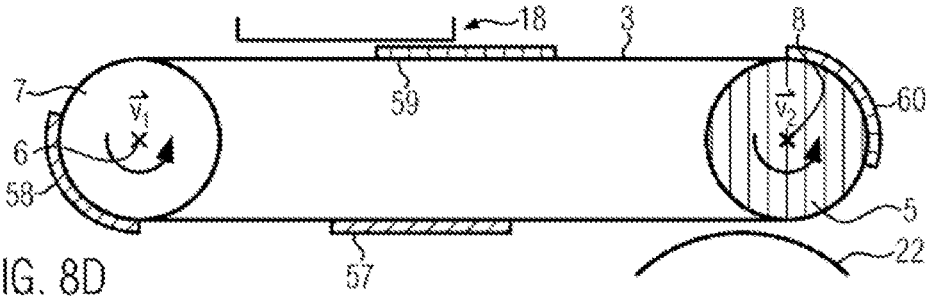

FIG. 8D shows a plan view at the point in time IV where both the first 2 and the second conveyor belt devices 3 and thus the respective film bag transport modules 57, 58; 59, 60 move at the speed $\overline{v1}$ or $\overline{v2}$, respectively. The first first film bag transport module 57 is on its way to the film bag dispensing position, the second first film bag transport module 58 has left the film bag receiving position, the first second film bag transport module 59 is on its way to the film bag receiving position, and the second second film bag transport module 60 has left the film bag dispensing position.

Figure 8E:
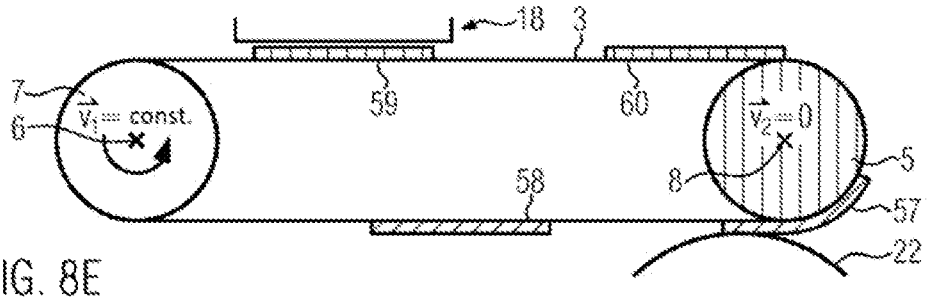

FIG. 8E shows a plan view at the point in time V. The first second film bag transport module 59 is located in the film bag receiving position underneath the film bag magazine 18 for receiving film bags from the film bag magazine 18. The second film bag conveyor device 3 is at rest to this end, i.e. $\overline{v2}=0$. The second second film bag transport module 60 is correspondingly also at rest.

The first first film bag transport module 57 is located in the film bag dispensing position, so that film bags may be transferred to the transfer wheel 22. The first film bag conveyor device 3 is moving at a constant speed, i.e. $\overline{v1}$=const. The second first film bag transport module 58 is on its way to the film bag dispensing position.

Figure 8F:
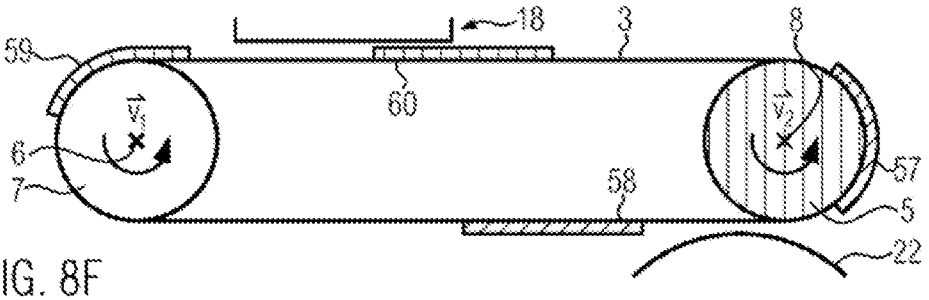

FIG. 8F shows a plan view at the point in time VI where both the first 2 and the second conveyor belt devices 3 and thus the respective film bag transport modules 57, 58; 59, 60 move at the speed $\overline{v1}$ or $\overline{v2}$, respectively. The first second film bag transport module 59 has left the film bag receiving position, the second second film bag transport module 60 is on its way thereto, the first first film bag transport module 57 has left the film bag dispensing position, and the second first film bag transport module 58 is on its way thereto.

Figure 8G:
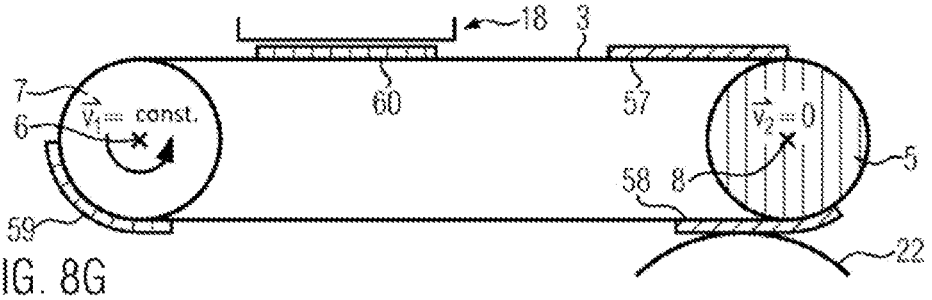

FIG. 8G shows a plan view at the point in time VII. The second second film bag transport module 60 is, for the transfer of film bags, in the film bag receiving position underneath the film bag magazine 18. The second film bag conveyor device 3 is at rest to this end, i.e. $\overline{v2}=0$. The first second film bag transport module 59 is correspondingly also at rest.

The first first film bag transport module 57 is on its way to the film bag receiving position, and the second first film bag transport module 58 is located in the film bag dispensing position to transfer the film bags to the transfer wheel 22. The first film bag conveyor device 2 is moving at a constant speed, i.e. $\overline{v1}$=const.

Figure 8H:
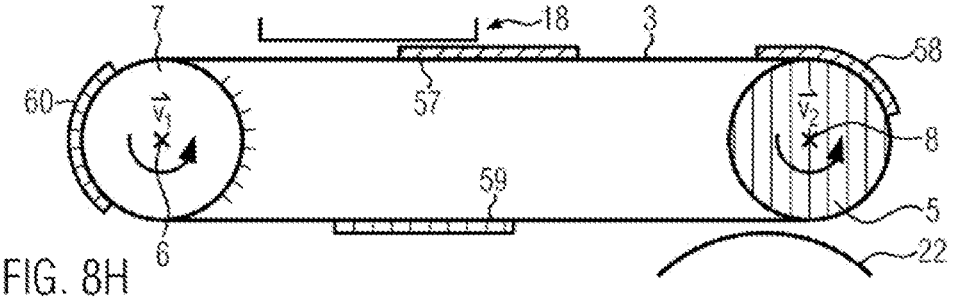

FIG. 8H shows a plan view at the point in time VIII where both the first 2 and the second conveyor belt devices 3 and thus the respective film bag transport module 57, 58; 59, 60 move at the speed $v\overline{v1}$ or $\overline{v2}$, respectively. The first second film bag transport module 59 is on its way to the film bag dispensing position, the second second film bag transport module 60 has left the film bag receiving position, the first first film bag transport module 57 is on its way to the film bag receiving position, and the second first film bag transport module 60 has left the film bag dispensing position.

While there have been shown and described fundamental novel features of the invention as applied to the preferred and exemplary embodiments thereof, it will be understood that omissions and substitutions and changes in the form and details of the disclosed invention may be made by those skilled in the art without departing from the spirit of the invention. Moreover, as is readily apparent, numerous modifications and changes may readily occur to those skilled in the art. Hence, it is not desired to limit the invention to the exact construction and operation shown and described and, accordingly, all suitable modification equivalents may be resorted to falling within the scope of the invention as claimed. It is the intention, therefore, to be limited only as indicated by the scope of the claims appended hereto.

The invention claimed is:

1. Device for receiving, transporting, and dispensing film bags, having:

a film bag magazine with multiple parallel magazine shafts for providing the film bags, characterized by two circulating conveyor belt devices which can be driven independently of each other, with film bag receiving areas arranged thereon which circulate about two common axes, wherein the two axes are drivable independently of each other and each axis drives one of the two conveyor belt devices;

a first drive device which is rotatable about one of the two axes, the so-called first axis, and drivable by the first axis, and a second drive device which is rotatable about the other one of the two axes, the so-called second axis, and drivable by the second axis;

a first deflection device which is rotatable about the second axis without being drivable by the second axis, and a second deflection device which is rotatable about the first axis without being drivable by the first axis, wherein at the first circulating conveyor belt device, a first number of film bag receiving areas is arranged, the first circulating conveyor belt device extends around the first drive device and around the first deflection device, and is drivable by the first drive device, wherein the film bag receiving areas are positionable underneath the magazine shafts for receiving the film bags in a film bag receiving position, and wherein at the second circulating conveyor belt device, a second number of film bag receiving areas is arranged and extends around the second drive device and around the second deflection device and is drivable by the second drive device, wherein the film bag receiving areas are positionable underneath the magazine shafts for receiving the film bags in the film bag receiving position.

2. Device according to claim 1, wherein the first conveyor belt device comprises one or multiple conveyor belts.

3. Device according to claim 1, wherein the second conveyor belt device comprises one or multiple conveyor belts.

4. Device according to claim 1, wherein the first number of film bag receiving areas arranged at the first conveyor belt device is configured as one or multiple film bag transport modules.

5. Device according claim 1, wherein the second number of film bag receiving areas arranged at the second conveyor belt device is configured as one or multiple film bag transport modules.

6. Device according to claim 1, furthermore comprising a transfer wheel in a film bag dispensing position, configured to receive film bags from the film bag receiving areas of the first conveyor belt device or the second conveyor belt device, respectively.

7. Method for receiving, transporting, and dispensing film bags with the device according to claim 1, including the steps of:

providing film bags in the magazine shafts of the magazine, moving the film bag receiving areas of the first conveyor belt device by means of the first drive device to a film bag receiving position, stopping the first conveyor belt device when film bag receiving areas of the first conveyor belt device are in a film bag receiving position, and transferring film bags from the magazine shafts to the film bag receiving areas of the first conveyor belt device, when the film bag receiving areas of the second conveyor belt device are in the film bag dispensing position, dispensing the film bags of the film bag receiving areas of the second conveyor belt device to a transfer wheel, upon transferring film bags from the magazine shafts to the film bag receiving areas of the first conveyor belt device, moving the film bag receiving areas by means of the first conveyor belt device to a film bag dispensing position, upon dispensing the film bags of the film bag receiving areas of the second conveyor belt device to a transfer wheel, moving the film bag receiving areas by means of the second conveyor belt device by means of the second drive device to the film bag receiving position, when the film bag receiving areas of the first conveyor belt device are in the film bag dispensing position, dispensing the film bags of the film bag receiving areas of the first conveyor belt device to the transfer wheel, moving the film bag receiving areas of the second conveyor belt device by means of the second drive device to the film bag receiving position, stopping the second conveyor belt device and transferring film bags from the magazine shafts to the film bag receiving areas of the second conveyor belt device, upon dispensing the film bags of the first conveyor belt device to the transfer wheel, moving the film bag receiving areas of the first conveyor belt device by means of the first drive device to the film bag receiving position, and upon transferring film bags from the magazine shafts to the film bag receiving areas of the second conveyor belt device, moving the film bag receiving areas of the second conveyor belt device to the film bag dispensing position.

* * * * *